US006434766B1

(12) United States Patent
Beddawi

(10) Patent No.: US 6,434,766 B1
(45) Date of Patent: Aug. 20, 2002

(54) SOFA AND BED COMBINATION

(75) Inventor: Sandra L. Beddawi, South Lake Tahoe, CA (US)

(73) Assignee: Virginia E. Beddawi, South Lake Tahoe, CA (US)

( * ) Notice: Subject to any disclaimer, the term of this patent is extended or adjusted under 35 U.S.C. 154(b) by 0 days.

(21) Appl. No.: 09/765,657

(22) Filed: Jan. 22, 2001

(51) Int. Cl.[7] ..... A47C 17/13; A47B 83/00

(52) U.S. Cl. ..... 5/18.1; 5/12.1; 5/8

(58) Field of Search ..... 5/18.1, 17, 12.1, 5/2.1, 7, 8, 9.1, 493, 21

(56) References Cited

U.S. PATENT DOCUMENTS

| | | | | | |
|---|---|---|---|---|---|
| 692,140 | A | * | 1/1902 | Hutchison et al. | 5/18.1 |
| 734,726 | A | * | 7/1903 | De Piniec-Mallet | 5/18.1 |
| 779,819 | A | * | 1/1905 | Thompson | 5/29 |
| 789,173 | A | * | 5/1905 | Rudnitzky | 5/18.1 |
| 815,118 | A | * | 3/1906 | Plunkett | 5/18.1 |
| 823,879 | A | * | 6/1906 | Kindel et al. | 5/45 |
| 987,064 | A | * | 3/1911 | Grotenhuis | 5/21 |
| 1,413,593 | A | * | 4/1922 | Kreuzkamp | 5/18.1 X |
| 1,413,595 | A | * | 4/1922 | Kreuzkamp | 5/18.1 |
| 1,505,616 | A | * | 8/1924 | Anderson | 5/18.1 |
| 1,574,760 | A | * | 3/1926 | Sisbower et al. | 5/18.1 X |
| 1,922,613 | A | * | 8/1933 | Bebry | 5/21 |
| 1,926,672 | A | * | 9/1933 | Foster | 5/18.1 |
| 1,946,822 | A | * | 2/1934 | Turner | 5/18.1 |
| 2,019,218 | A | * | 10/1935 | Fox et al. | 5/18.1 |
| 2,056,727 | A | * | 10/1936 | Krakauer et al. | 5/18.1 |
| 2,095,997 | A | * | 10/1937 | Martin | 5/18.1 |
| 2,096,059 | A | * | 10/1937 | Perlesz | 5/18.1 |
| 2,118,050 | A | * | 5/1938 | Martin | 5/18.1 |
| 2,123,326 | A | * | 7/1938 | Basile | 5/18.1 |
| 2,135,687 | A | * | 11/1938 | Woller | 5/21 |
| 2,143,355 | A | * | 1/1939 | Martin | 5/18.1 |
| 2,150,879 | A | * | 3/1939 | Fox | 5/21 |
| 2,151,257 | A | * | 3/1939 | Wuest et al. | 5/18.1 |
| 2,162,146 | A | * | 6/1939 | Wesley | 5/21 |
| 2,167,175 | A | * | 7/1939 | Fox | 5/21 |
| 2,190,819 | A | * | 2/1940 | Andrews | 5/18.1 |

(List continued on next page.)

FOREIGN PATENT DOCUMENTS

| | | | | |
|---|---|---|---|---|
| AU | 158980 | * | 9/1954 | 5/21 |
| CA | 999103 | * | 11/1976 | 5/12.1 |
| DE | 23636 | * | 9/1962 | 5/8 |
| DE | 2722003 | * | 11/1978 | 5/18.1 |
| DE | 3444675 | * | 6/1986 | 5/18.1 |
| FR | A064114 | * | 10/1955 | 5/12.1 |
| FR | 1193309 | * | 11/1959 | 5/18.1 |
| FR | 1305669 | * | 8/1962 | 5/8 |
| GB | 830123 | * | 3/1960 | 5/8 |
| NO | 29869 | * | 7/1919 | 5/18.1 |
| NO | 80711 | * | 9/1952 | 5/21 |
| SE | 86404 | * | 5/1936 | 5/21 |

*Primary Examiner*—Robert G. Santos

(57) ABSTRACT

A sofa and bed combination for providing multiple individual sleeping areas in one article. The sofa and bed combination includes a sofa having a back portion and two arm portions. Each of the arm portions is securely coupled to opposite ends of the back portion. Each of the arm portions extends in a generally parallel direction with relation to each other. A first platform extends between and is securely coupled to the arm portions. A second platform has a top surface and a bottom surface. The second platform has a length generally equal to a distance between the arm portions and a width generally equal to distance from the back portion to an outer edge of the arm portions. The second platform has four corners. Each of four legs is integrally coupled to and extends downwardly from the bottom surface of the second platform. Each of the legs is positioned generally adjacent to one of the four corners. Each of four wheels is rotatably coupled to one of the legs. The second platform is removably positionable under the first platform. Each of a pair of mattresses is positionable on one of the first and second platforms.

8 Claims, 3 Drawing Sheets

U.S. PATENT DOCUMENTS 2,233,864 A * 3/1941 Edson ..... 5/499
2,238,729 A * 4/1941 Halleran ..... 5/21
2,238,765 A * 4/1941 Woller ..... 5/21
2,365,848 A * 12/1944 Stone ..... 5/18.1
2,627,076 A * 2/1953 Mitzenmacher ..... 5/18.1
2,703,411 A * 3/1955 Kelly ..... 5/18.1
2,760,210 A * 8/1956 Bebry ..... 5/21
3,321,776 A 5/1967 Black
3,325,830 A 6/1967 Black
3,385,631 A * 5/1968 Gertler ..... 5/18.1 X
3,652,373 A * 3/1972 Noble ..... 112/418
3,657,750 A * 4/1972 Staley ..... 5/493
3,710,403 A * 1/1973 Weidner et al. ..... 5/18.1
3,855,650 A * 12/1974 Neunherz et al. ..... 5/21
3,972,079 A * 8/1976 Shellow et al. ..... 5/38
4,134,613 A * 1/1979 Logan, Jr. ..... 5/18.1 X
4,204,287 A * 5/1980 Lane et al. ..... 5/18.1
4,232,411 A 11/1980 Speyer
4,481,684 A * 11/1984 Hauck ..... 5/18.1
4,745,643 A 5/1988 Clarke
D351,077 S 10/1994 Bressler
5,540,480 A * 7/1996 Christa ..... 297/219.1
D381,830 S 8/1997 Fisher

* cited by examiner

SOFA AND BED COMBINATION

BACKGROUND OF THE INVENTION

1. Field of the Invention

The present invention relates to sofa and bed combination devices and more particularly pertains to a new sofa and bed combination for providing multiple individual sleeping areas in one article.

2. Description of the Prior Art

The use of sofa and bed combination devices is known in the prior art. More specifically, sofa and bed combination devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,745,643; U.S. Pat. No. 3,321,776; U.S. Pat. No. 4,232,411; Des. U.S. Pat. No. 351,077; Des. U.S. Pat. No. 381,830; and U.S. Pat. No. 3,325,830.

While these devices fulfill their respective, particular objectives and requirements, the aforementioned patents do not disclose a new sofa and bed combination. The inventive device includes a sofa having a back portion and two arm portions. Each of the arm portions is securely coupled to opposite ends of the back portion. Each of the arm portions extends in a generally parallel direction with relation to each other. A first platform extends between and is securely coupled to the arm portions. A second platform has a top surface and a bottom surface. The second platform has a length generally equal to a distance between the arm portions and a width generally equal to distance from the back portion to an outer edge of the arm portions. The second platform has four corners. Each of four legs is integrally coupled to and extends downwardly from the bottom surface of the second platform. Each of the legs is positioned generally adjacent to one of the four corners. Each of four wheels is rotatably coupled to one of the legs. The second platform is removably positionable under the first platform. Each of a pair of mattresses is positionable on one of the first and second platforms.

In these respects, the sofa and bed combination according to the present invention substantially departs from the conventional concepts and designs of the prior art, and in so doing provides an apparatus primarily developed for the purpose of providing multiple individual sleeping areas in one article.

SUMMARY OF THE INVENTION

In view of the foregoing disadvantages inherent in the known types of sofa and bed combination devices now present in the prior art, the present invention provides a new sofa and bed combination construction wherein the same can be utilized for providing multiple individual sleeping areas in one article.

The general purpose of the present invention, which will be described subsequently in greater detail, is to provide a new sofa and bed combination apparatus and method which has many of the advantages of the sofa and bed combination devices mentioned heretofore and many novel features that result in a new sofa and bed combination which is not anticipated, rendered obvious, suggested, or even implied by any of the prior art sofa and bed combination devices, either alone or in any combination thereof.

To attain this, the present invention generally comprises a sofa having a back portion and two arm portions. Each of the arm portions is securely coupled to opposite ends of the back portion. Each of the arm portions extends in a generally parallel direction with relation to each other. A first platform extends between and is securely coupled to the arm portions. A second platform has a top surface and a bottom surface. The second platform has a length generally equal to a distance between the arm portions and a width generally equal to distance from the back portion to an outer edge of the arm portions. The second platform has four corners. Each of four legs is integrally coupled to and extends downwardly from the bottom surface of the second platform. Each of the legs is positioned generally adjacent to one of the four corners. Each of four wheels is rotatably coupled to one of the legs. The second platform is removably positionable under the first platform. Each of a pair of mattresses is positionable on one of the first and second platforms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sofa and bed combination apparatus and method which has many of the advantages of the sofa and bed combination devices mentioned heretofore and many novel features that result in a new sofa and bed combination which is not anticipated, rendered obvious, suggested, or even implied by any of the prior art sofa and bed combination devices, either alone or in any combination thereof.

It is another object of the present invention to provide a new sofa and bed combination which may be easily and efficiently manufactured and marketed.

It is a further object of the present invention to provide a new sofa and bed combination which is of a durable and reliable construction.

An even further object of the present invention is to provide a new sofa and bed combination which is susceptible of a low cost of manufacture with regard to both materials and labor, and which accordingly is then susceptible of low prices of sale to the consuming public, thereby making such sofa and bed combination economically available to the buying public.

Still yet another object of the present invention is to provide a new sofa and bed combination which provides in the apparatuses and methods of the prior art some of the advantages thereof, while simultaneously overcoming some of the disadvantages normally associated therewith.

Still another object of the present invention is to provide a new sofa and bed combination for providing multiple individual sleeping areas in one article.

Yet another object of the present invention is to provide a new sofa and bed combination which includes a sofa having a back portion and two arm portions. Each of the arm portions is securely coupled to opposite ends of the back portion. Each of the arm portions extends in a generally parallel direction with relation to each other. A first platform extends between and is securely coupled to the arm portions. A second platform has a top surface and a bottom surface. The second platform has a length generally equal to a distance between the arm portions and a width generally equal to distance from the back portion to an outer edge of the arm portions. The second platform has four corners. Each of four legs is integrally coupled to and extends downwardly from the bottom surface of the second platform. Each of the legs is positioned generally adjacent to one of the four corners. Each of four wheels is rotatably coupled to one of the legs. The second platform is removably positionable under the first platform. Each of a pair of mattresses is positionable on one of the first and second platforms.

Still yet another object of the present invention is to provide a new sofa and bed combination that has two removable platforms, each of which providing a sleeping area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
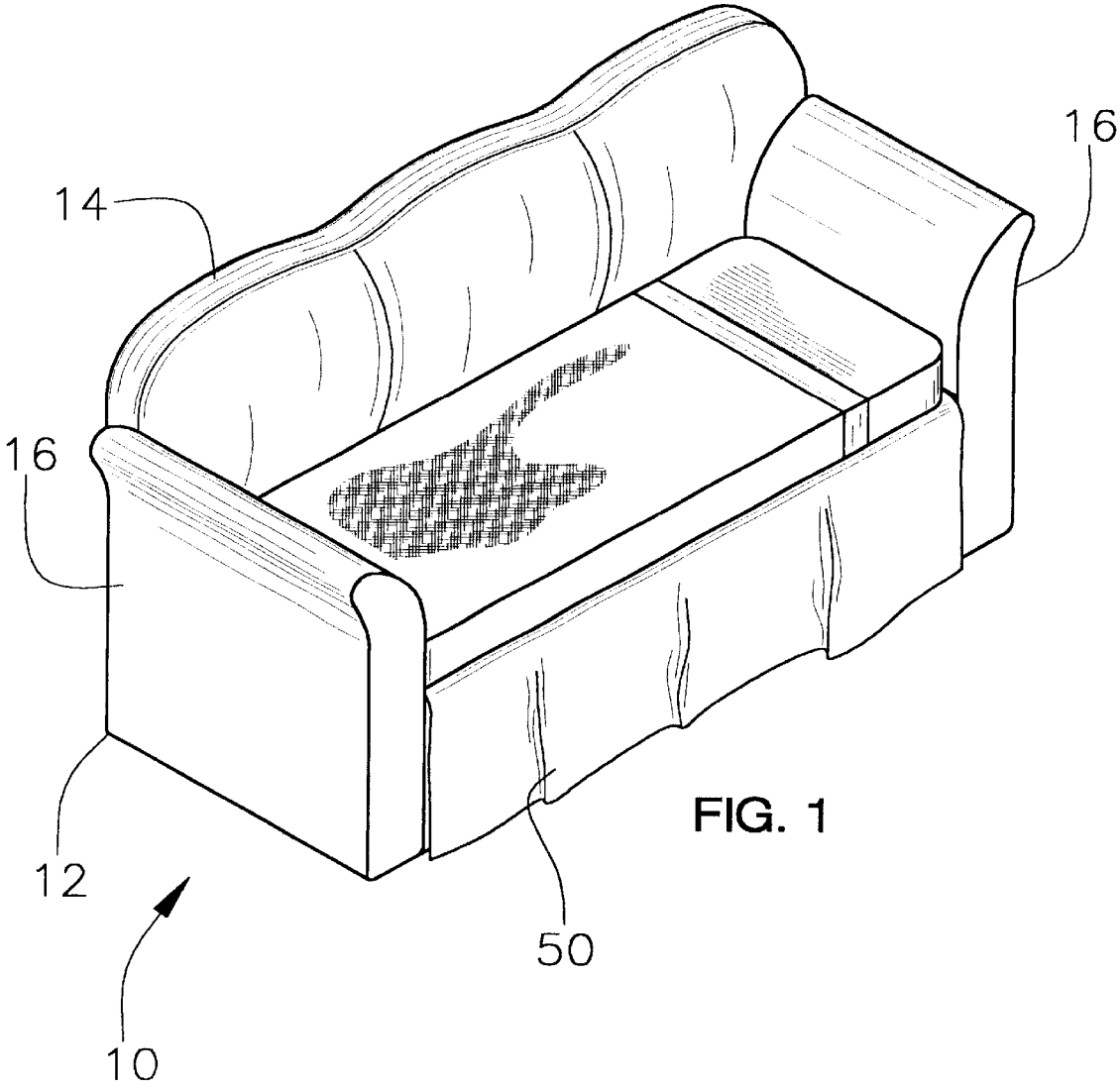
FIG. 1 is a schematic perspective view of a new sofa and bed combination according to the present invention.
Figure 2:
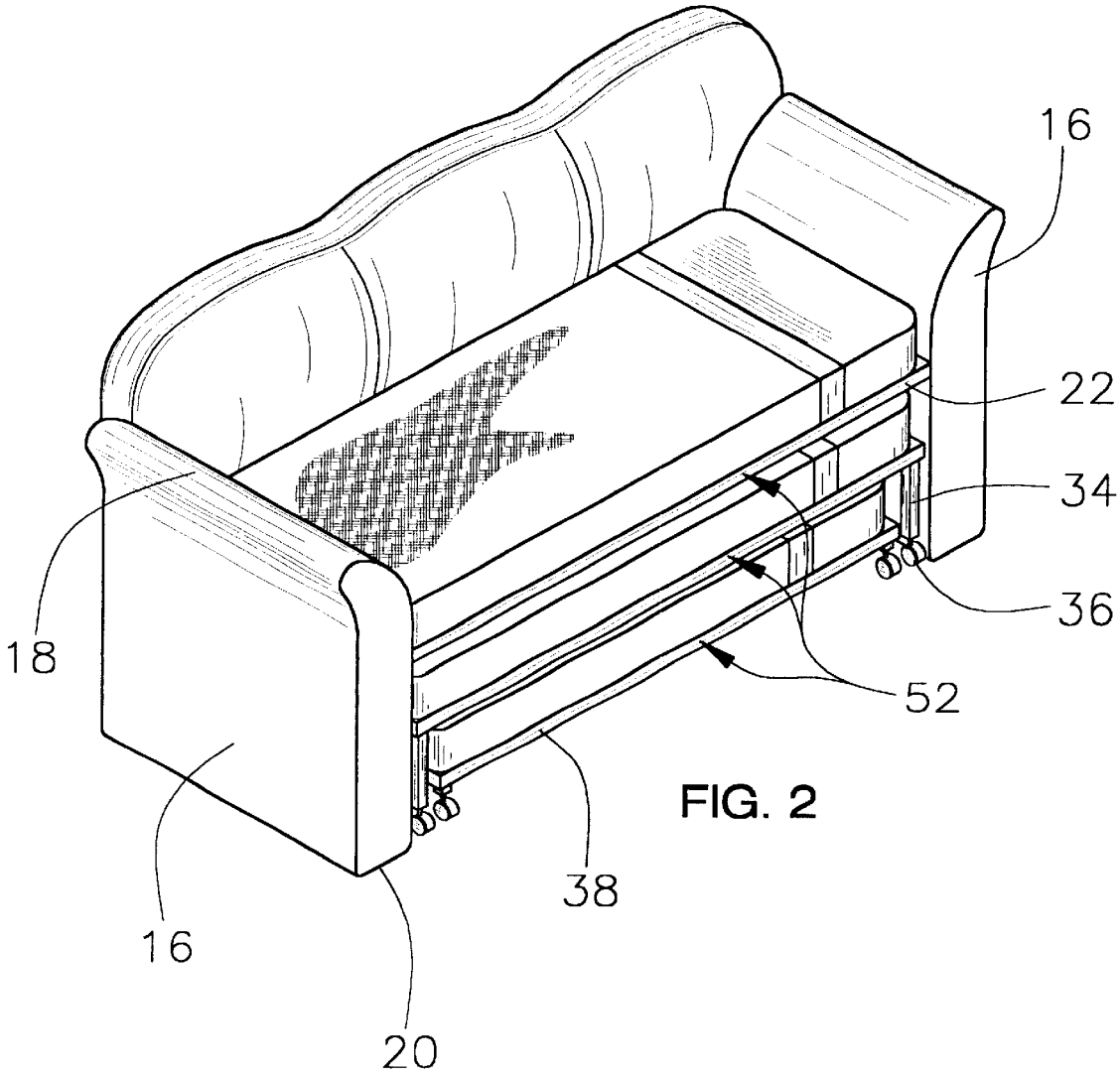
FIG. 2 is a schematic perspective view of the present invention.
Figure 3:
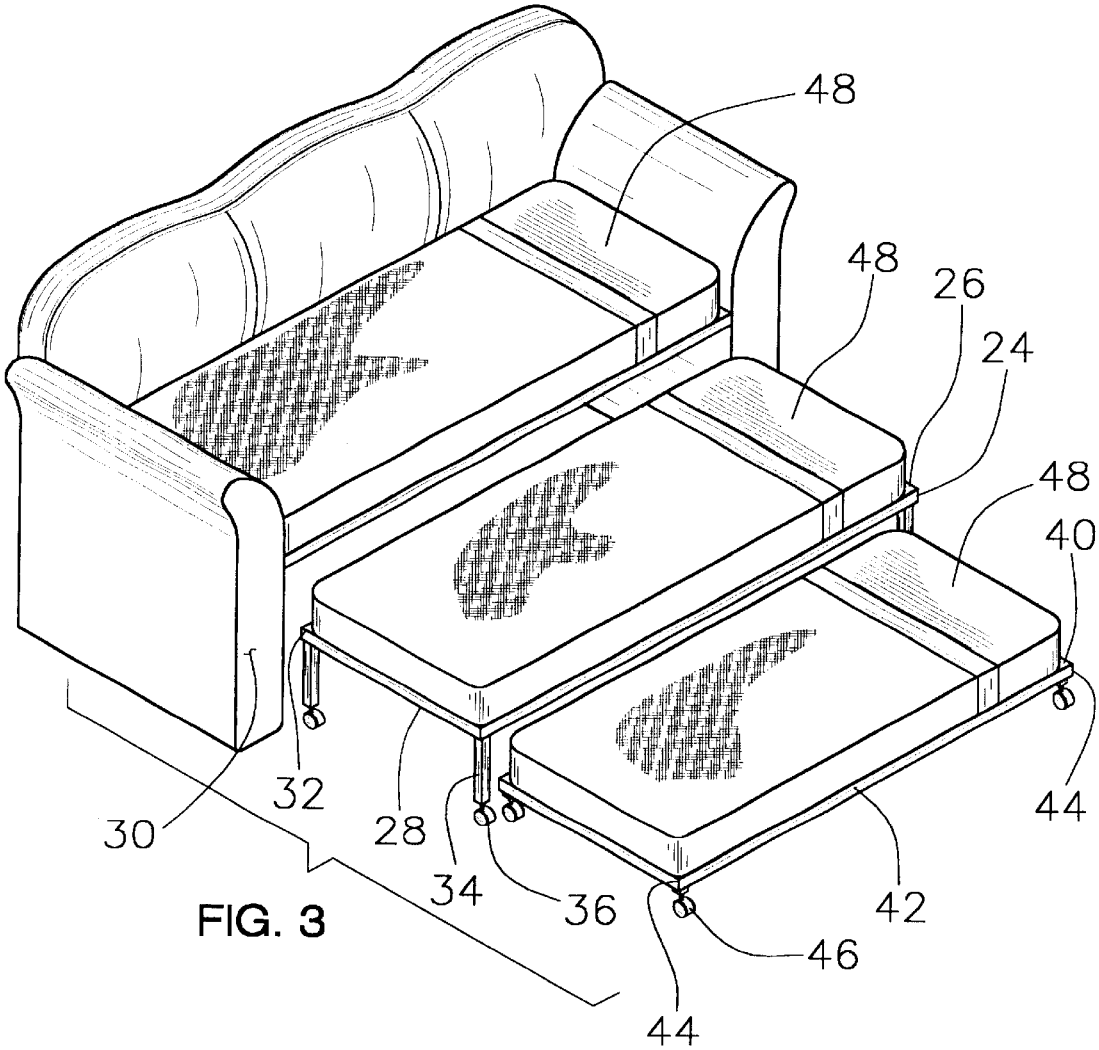
FIG. 3 is a schematic perspective view of the present invention.

With reference now to the drawings, and in particular to FIGS. 1 through 3 thereof, a new sofa and bed combination embodying the principles and concepts of the present invention and generally designated by the reference numeral 10 will be described.

As best illustrated in FIGS. 1 through 3, the sofa and bed combination 10 generally comprises a sofa 12 having a back portion 14 and two arm portions 16. Each of the arm portions 16 is securely coupled to opposite ends of the back portion 12. Each of the arm portions 14 extends in a generally parallel direction with relation to each other. The arm portions 14 each have a top side 18 and a bottom side 20.

A first platform 22 extends between and is securely coupled to the arm portions 14. The first platform 22 is orientated generally horizontal and is positioned nearer the top side 18 than the bottom side 20 of the arm portions 14.

A second platform 24 has a top surface 26 and a bottom surface 28. The second platform 24 has a length generally equal to a distance between the arm portions 16 and a width generally equal to distance from the back portion 14 to an outer edge 30 of the arm portions 16. The second platform 24 has four corners 32. Each of four legs 34 is integrally coupled to and extending downwardly from the bottom surface 28 of the second platform 24. Each of the legs 34 is positioned generally adjacent to one of the four corners 32. Each of four wheels 36 is rotatably coupled to one of the legs 34. The second platform 24 is removably positionable below the first platform 22 such that the first platform 22 is between 3 inches and 9 inches away from the second platform 24.

A third platform 38 has a top surface 40 and a bottom surface 42. The third platform 38 has a length and width generally equal to a length and width between the legs 34 on the second platform 24. The third platform 38 has four corners 44. Each of four wheels 46 is rotatably coupled to the bottom surface 42 of the third platform 38 and positioned generally adjacent to one of the corners 44 of the third platform 38. The third platform 38 is removably positionable below the second platform 24 such that the second platform 24 is between 3 inches and 9 inches away from the third platform 38.

Each of a plurality of mattresses 48 is positionable on one of the first 22, second 24 and third 38 platforms. A height of a mattress 48 on the second platform 24 is less than the distance between the second platform 24 and the first platform 22. A height of a mattress on the third platform 38 is less than the distance between the second platform 24 and the third platform 38.

A panel 50 is positioned over an outer edge 52 of the platforms 22, 24, 38 facing away from the back portion 14. The panel 50 is a cloth panel having a length generally equal to the distance between the arm portions 16 and height greater than a distance between the first platform 22 and the bottom side 20 of the arm portions 16. The panel 50 is positioned on the first platform 22 such that the panel 50 extends downwardly and substantially covers the outer edges 52 of the platforms.

In use, the top platform 22 allows a user to use the device as a traditional sofa. If needed, the second 22 and third 38 platforms may be rolled out from underneath the first panel 22 and serve as sleeping areas. Combined with the first platform 22, this offers 3 individual sleeping areas within one device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sofa and bed combination device, said device including:

a sofa having a back portion and two arm portions, each of said arm portions being securely coupled to opposite ends of said back portion, each of said arm portions extending in a generally parallel direction with relation to each other;

a first platform extending between and being securely coupled to said arm portions;

a second platform having a top surface and a bottom surface, said second platform having a length generally equal to a distance between said arm portions and a width generally equal to distance from said back portion to an outer edge of said arm portions, said second platform having four corners, each of four legs being integrally coupled to and extending downwardly from said bottom surface of said second platform, each of said legs being positioned generally adjacent to one of said four corners, each of four wheels being rotatably coupled to one of said legs, said second platform being removably positionable under said first platform;

a first mattress positionable on said first platform, said first mattress providing a bottom surface for supporting a user when seated upon said sofa, said first mattress providing a horizontal support surface for a user in a laying position; and a second mattress positionable on said second platform such that said second mattress rests upon said second platform when stored, said second mattress providing a support surface for a user laying upon said second mattress when said second platform is moved from beneath said first platform.

2. The sofa and bed combination device as in claim 1, wherein said device further includes:

each of said arm portions having a top side and a bottom side;

said first platform being orientated generally horizontal and positioned nearer said top side than said bottom side of said arm portions; and said second platform being positionable below said first platform such that said first platform distance is between 3 inches and 9 inches away from said second platform.

3. The sofa and bed combination device as in claim 2, further including:

a third platform having a top surface and a bottom surface, said third platform having a length and width generally equal to a length and width between said legs on said second platform, said third platform having four corners, each of four wheels being rotatably coupled to said bottom surface of said third platform and positioned generally adjacent to one of said corners of said third platform, said third platform being removably positionable below said second platform; and said third platform having a third mattress thereon.

4. The sofa and bed combination device as in claim 3, wherein said second platform is between 3 inches and 9 inches away from said third platform.

5. The sofa and bed combination device as in claim 1, further including:

a third platform having a top surface and a bottom surface, said third platform having a length and width generally equal to a length and width between said legs on said second platform, said third platform having four corners, each of four wheels being rotatably coupled to said bottom surface of said third platform and positioned generally adjacent to one of said corners of said third platform, said third platform being removably positionable below said second platform; and said third platform having a third mattress thereon.

6. The sofa and bed combination device as in claim 5, further including:

a panel for positioning over an outer edge of said platforms facing away from said back portion, said panel being a cloth panel having a length generally equal to said distance between said arm portions and height greater than a distance between said first platform and said bottom side of said arm portions, wherein said panel is positioned on said first platform such that said panel extends downwardly and substantially covers said outer edges of said platforms.

7. The sofa and bed combination device as in claim 1, further including:

a panel for positioning over an outer edge of said platforms facing away from said back portion, said panel being a cloth panel having a length generally equal to said distance between said arm portions and height greater than a distance between said first platform and said bottom side of said arm portions, wherein said panel is positioned on said first platform such that said panel extends downwardly and substantially covers said outer edges of said platforms.

8. A sofa and bed combination device, said device including:

a sofa having a back portion and two arm portions, each of said arm portions being securely coupled to opposite ends of said back portion, each of said arm portions extending in a generally parallel direction with relation to each other, each of said arm portions having a top side and a bottom side;

a first platform extending between and being securely coupled to said arm portions, said first platform being orientated generally horizontal and positioned nearer said top side than said bottom side of said arm portions;

a second platform having a top surface and a bottom surface, said second platform having a length generally equal to a distance between said arm portions and a width generally equal to distance from said back portion to an outer edge of said arm portions, said second platform having four corners, each of four legs being integrally coupled to and extending downwardly from said bottom surface of said second platform, each of said legs being positioned generally adjacent to one of said four corners, each of four wheels being rotatably coupled to one of said legs, said second platform being removably positionable below said first platform such that said first platform is between 3 inches and 9 inches away from said second platform;

a third platform having a top surface and a bottom surface, said third platform having a length and width generally equal to a length and width between said legs on said second platform, said third platform having four corners, each of four wheels being rotatably coupled to said bottom surface of said third platform and positioned generally adjacent to one of said corners of said third platform, said third platform being removably positionable below said second platform such that said second platform is between 3 inches and 9 inches away from said third platform;

a plurality of mattresses, each of said mattresses being positionable on an associated one of said first, second and third platforms, a height of a mattress on said second platform being less than the distance between said second platform and said first platform, a height of a mattress on said third platform being less than the distance between said second platform and said third platform;

a panel for positioning over an outer edge of said platforms facing away from said back portion, said panel being a cloth panel having a length generally equal to said distance between said arm portions and height greater than a distance between said first platform and said bottom side of said arm portions, wherein said panel is positioned on said first platform such that said panel extends downwardly and substantially covers said outer edges of said platforms.

* * * * *